US008102327B2

(12) United States Patent
Johnson

(10) Patent No.: US 8,102,327 B2
(45) Date of Patent: Jan. 24, 2012

(54) BALANCED MICROSTRIP FOLDED DIPOLE ANTENNAS AND MATCHING NETWORKS

(75) Inventor: Karin Anne Johnson, Palm Harbor, FL (US)

(73) Assignee: The Nielsen Company (US), LLC, Schaumburg, IL (US)

( * ) Notice: Subject to any disclaimer, the term of this patent is extended or adjusted under 35 U.S.C. 154(b) by 436 days.

(21) Appl. No.: 12/475,757

(22) Filed: Jun. 1, 2009

(65) Prior Publication Data

US 2010/0302117 A1 Dec. 2, 2010

(51) Int. Cl.
*H01Q 9/26* (2006.01)

(52) U.S. Cl. ..... 343/803; 343/700 MS

(58) Field of Classification Search ..... 343/803, 343/702, 795, 841, 818–819, 700 MS; 340/10.2
See application file for complete search history.

(56) References Cited

U.S. PATENT DOCUMENTS

| | | | | |
|---|---|---|---|---|
| 5,539,414 | A | 7/1996 | Keen | |
| 6,317,099 | B1 | 11/2001 | Zimmerman et al. | |
| 6,653,983 | B2 * | 11/2003 | Masuda et al. | 343/767 |
| 6,987,483 | B2 | 1/2006 | Tran | |
| 7,095,372 | B2 | 8/2006 | Soler Castany et al. | |
| 7,098,863 | B2 | 8/2006 | Bancroft | |
| 7,119,745 | B2 | 10/2006 | Gaucher et al. | |
| 7,148,846 | B2 | 12/2006 | Qi et al. | |
| 7,183,984 | B2 | 2/2007 | Jarmuszewski et al. | |
| 7,239,291 | B2 | 7/2007 | Walton | |
| 7,327,315 | B2 * | 2/2008 | Starkie et al. | 343/700 MS |
| 7,423,596 | B2 | 9/2008 | Maniwa et al. | |
| 7,423,606 | B2 * | 9/2008 | Knadle et al. | 343/819 |
| 2002/0060647 | A1 * | 5/2002 | Masuda et al. | 343/767 |
| 2006/0038724 | A1 | 2/2006 | Tikhov et al. | |
| 2006/0256018 | A1 * | 11/2006 | Soler Castany et al. | 343/700 MS |
| 2006/0276157 | A1 | 12/2006 | Chen et al. | |
| 2007/0013599 | A1 | 1/2007 | Gaucher et al. | |
| 2007/0164907 | A1 | 7/2007 | Gaucher et al. | |
| 2008/0231517 | A1 | 9/2008 | Zheng | |
| 2008/0252535 | A1 | 10/2008 | Parsche | |

* cited by examiner

*Primary Examiner* — Huedung Mancuso
(74) *Attorney, Agent, or Firm* — Hanley, Flight & Zimmerman, LLC

(57) ABSTRACT

Balanced microstrip folded dipole antennas and matching networks are disclosed. In some examples, an antenna system includes a printed circuit board having first and second dielectric layers, and respective portions of the first and second dielectric layers bound a ground plane. The system further includes a balanced folded dipole, wherein a first portion of the folded dipole is located on the first dielectric layer, and a second portion is located on the second dielectric layer. First and second transmission lines are coupled to respective folded dipole portions. A matching network includes first and second portions that are coupled to respective transmission lines and have equal impedances. Each matching network portion includes a tapered first microstrip, having a narrow end coupled to a respective transmission line, a second microstrip coupled to the first microstrip, and a third microstrip coupled orthogonally to the second microstrip via a mitered bend.

20 Claims, 4 Drawing Sheets

BALANCED MICROSTRIP FOLDED DIPOLE ANTENNAS AND MATCHING NETWORKS

FIELD OF THE DISCLOSURE

This disclosure relates generally to radio frequency transceivers and communications and, more particularly, to microstrip planar folded dipole antennas and matching networks.

BACKGROUND

Dipole antennas are commonly found in many wireless transmitter and receiver applications. A variation on the dipole antenna is the folded dipole antenna, which offers a wider bandwidth and increased input impedance compared to a corresponding dipole antenna for a given wire length.

Antennas may be implemented using conductive traces printed circuit boards on which a transceiver chip is mounted. Such configurations may result in cheaper transceiver and antenna combinations. The antenna impedance usually must be appropriately matched to the transceiver impedance for optimal power transfer. Matching networks generally include one or more discrete circuit components to achieve a desired impedance.

DETAILED DESCRIPTION

Certain example methods and apparatus are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness. Although the following discloses example methods and apparatus, it should be noted that such methods and apparatus are merely illustrative and should not be considered as limiting. The example circuits described herein may be implemented using discrete components, integrated circuits (ICs), or any combination thereof. Accordingly, while the following describes example methods and apparatus, persons of ordinary skill in the art will readily appreciate that the examples are not the only way to implement such apparatus.

Balanced microstrip folded dipole antennas and matching networks are described below. In some examples, an antenna system includes a printed circuit board having first and second dielectric layers, and respective portions of the first and second dielectric layers bound a ground plane. The system further includes a balanced folded dipole, wherein a first portion of the folded dipole is located on the first dielectric layer, and a second portion of the folded dipole is located on the second dielectric layer. First and second transmission lines are coupled to respective folded dipole portions. A matching network includes first and second portions that are coupled to respective transmission lines and have equal impedances. Each matching network portion includes a tapered first microstrip having a narrow end coupled to a respective transmission line, a second microstrip coupled to the first microstrip, and a third microstrip coupled orthogonally to the second microstrip via a mitered bend.

The example methods and apparatus described herein may be used to provide balanced folded dipole antennas and matching networks implemented on printed circuit boards. In some examples, the printed circuit board includes a folded dipole antenna, a matching network, and transmission lines connecting the antenna and the matching network, implemented using microstrip conductor traces. In some examples, all of the folded dipole antenna, matching network, and transmission lines are balanced and may be configured to provide improved efficiency and performance between the apparatus and a corresponding transceiver. Additionally, the antenna performance is not substantially dependent on a ground plane, so antenna operation is more reliable and has a greater communications range than previously-known designs.

Figure 1:
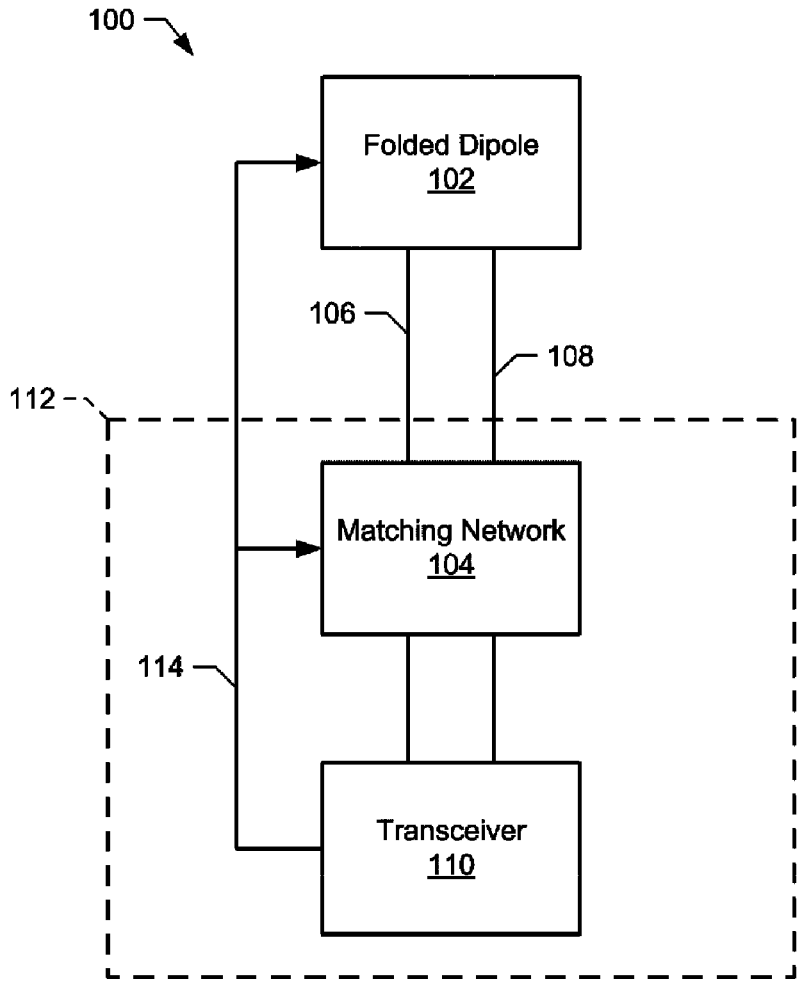
FIG. 1 is a block diagram of an example balanced microstrip antenna system.

FIG. 1 is a block diagram of an example balanced microstrip antenna system 100. The example antenna system 100 is implemented using a printed circuit board (PCB), such as the PCB 200 illustrated in FIG. 2 below, by affixing microstrip conductors and circuit components to the layers 102 and 106 of the PCB 200. The example antenna system 100 includes a folded dipole 102, a matching network 104, balanced transmission lines 106 and 108, and a transceiver 110.

The antenna system 100 is at least partially located in an area adjacent a ground plane 112. In particular, the example matching network 104, the example transceiver 110, and at least a portion of the transmission lines 106 and 108 are located adjacent the ground plane 112 on different PCB 200 layers as described below. However, in some examples, the folded dipole 102 is not located adjacent the ground plane 112, as the ground plane 112 would change the characteristics of the folded dipole 102 as described below. In some other examples, the transmission lines 106 and 108 and a portion of the matching network 104 are not adjacent the ground plane 112.

The transceiver 110 is further coupled to the matching network 104 and the folded dipole 102 via a direct current (DC) connection 114 to provide DC power. In some examples, the transceiver 110 receives power at the transceiver's 110 terminals via the antenna system 100. In transmission mode, the antenna system 100 requires power sufficient to achieve a desired broadcast power at the folded dipole 102. In receive mode, the transceiver 110 does not require DC power to be provided via the antenna system 100, and instead receives the power in the received signals.

Figure 2:
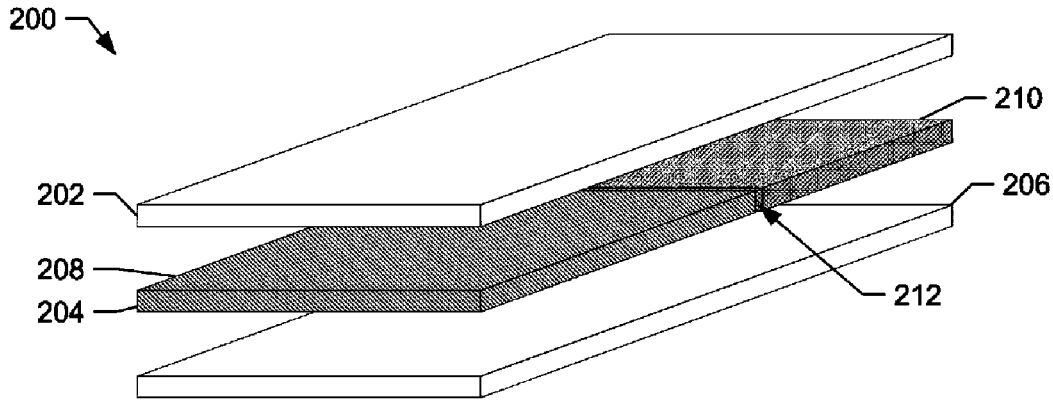
FIG. 2 is a perspective view of an example multi-layered printed circuit board on which a balanced microstrip folded dipole antenna and matching network may be implemented.

FIG. 2 is a perspective view of an example multi-layered PCB 200 on which a balanced microstrip folded dipole antenna and matching network may be implemented. The example PCB 200 includes three layers 202, 204 and 206. However, any three or more layer PCBs 200 may be used. In the illustrated example, the top layer 202 is constructed using a dielectric material. Similarly, the bottom layer 206 is also constructed using a dielectric material, which may be the same as or different than the dielectric material used to construct the top layer 202. Using PCB techniques, microstrips of conducting material may be affixed to either or both of the dielectric layers 202 or 206. The microstrips may be used to mount circuit components or route signals between circuit components.

There are many dielectric materials suitable for use in the example PCB 200, and each has at least a permittivity and a conductivity that directly affects the characteristics of an antenna located thereon. Thus, the dielectric material will be different based on the desired operational characteristics of the antenna. In some examples, the dielectric material is a low-loss microwave substrate. In some other examples, the dielectric material is Nelco N4000-13 EP™ SI material, manufactured by Park Electrochemical Corp.

An intermediate layer 204 is located physically between the top 202 and bottom 206 layers. The intermediate layer 204 includes at least two distinct portions: a first portion 208 constructed with a conductive material, and a second portion 210 constructed with a dielectric material. In the illustrated example, a separation area 212 exists between the first 208 and second 210 portions of the intermediate layer 204. The separation area 212 may include a material different than the conductive material used in the first portion 208 and the second portion 210 and/or may include empty space. The conductive material of the first portion 208 acts as a ground plane (e.g., the ground plane 112 of FIG. 1), or common reference voltage, for at least a portion of the circuitry located on the PCB 200. The dielectric material of the second portion 210 may be the same as or different than the materials used in the top 202 or bottom 206 layers.

Figure 3:
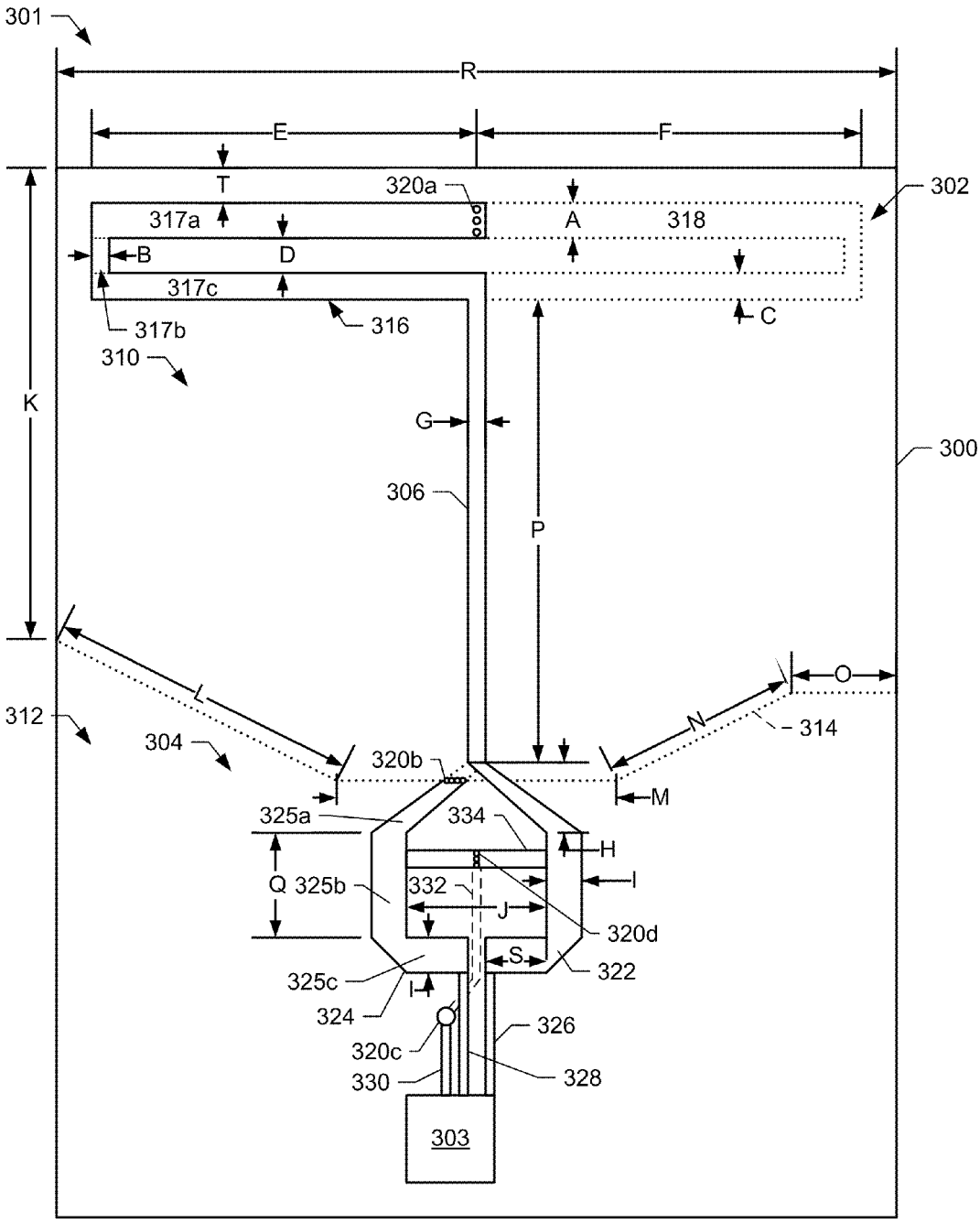
FIG. 3 is a view of a first side of an example multi-layered printed circuit board having a balanced microstrip folded dipole antenna and matching network.
Figure 4:
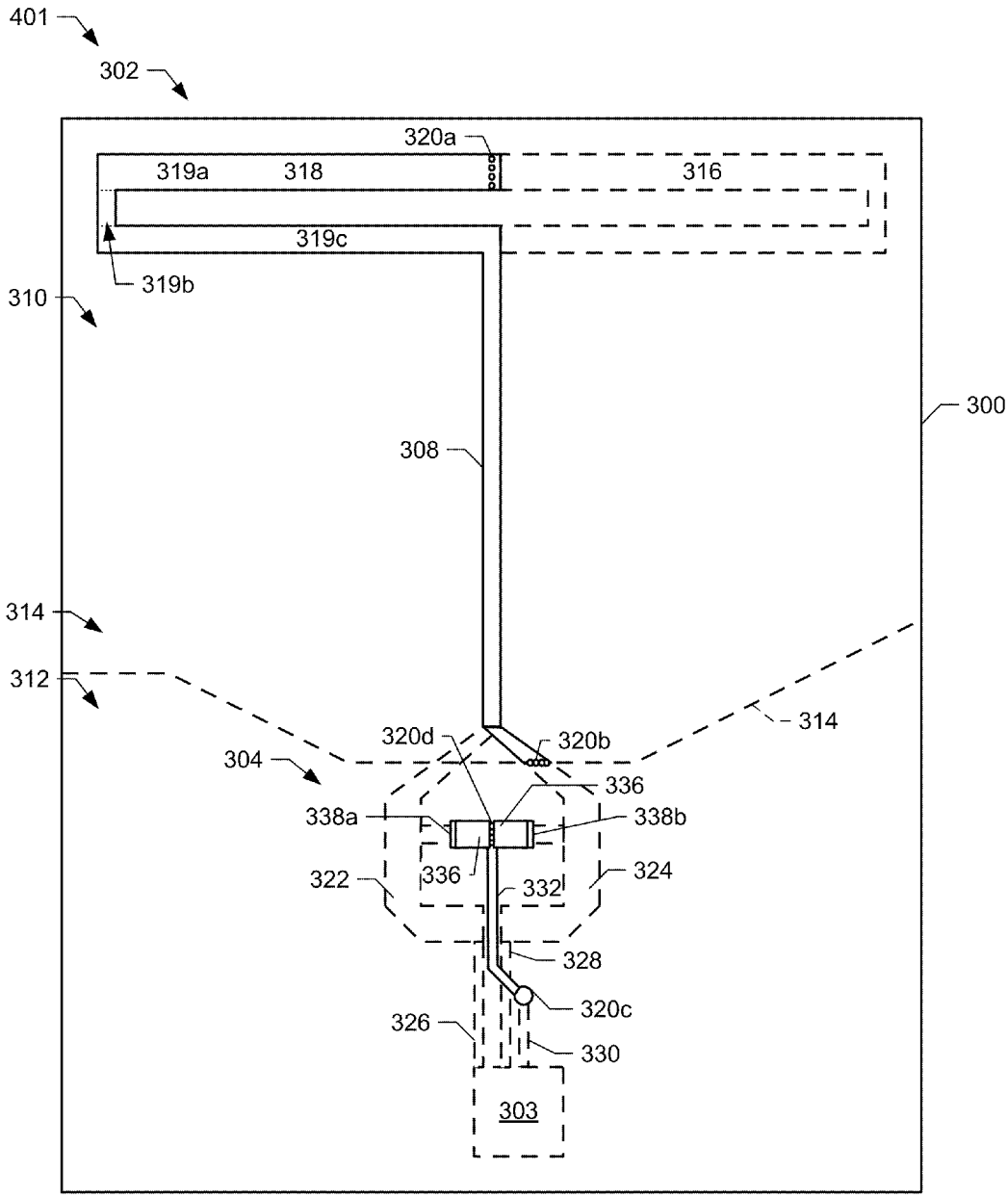
FIG. 4 is a view of the second side of the example multi-layered printed circuit board of FIG. 3.

In the examples of FIGS. 3 and 4, the visible portions (i.e., the portions located on the viewed side) of the illustrated components are shown using solid lines, and the non-visible portions (i.e., the portions located on the non-viewed side) are shown using dashed lines. Where there are components on the viewed side that cover components on the non-viewed side, only the components on the viewed side are shown.

FIG. 3 is a plan view of a first side 301 of an example multi-layered PCB 300 having a balanced microstrip folded dipole antenna 302 and matching network 304. The example folded dipole antenna 302 and matching network 304 are coupled via a first transmission line 306 and a second transmission line that is located on a second side 401 of the PCB 300 directly opposite the transmission line 306 and is indicated using reference numeral 308. The illustrated example of FIGS. 3 and 4 are used to implement the balanced microstrip antenna system 100 of FIG. 1 and/or the PCB 200 of FIG. 2. For example, the first side 301 of the PCB 300 may be used to implement the example dielectric layer 202 of FIG. 2 and the second side 401 may be used to implement the example dielectric layer 206. A transceiver 303 is coupled to the folded dipole antenna 302 via the matching network 304 and the transmission lines 306 and 308 to transmit and receive electromagnetic signals.

The dimensions of the folded dipole 302 determine the transmission and reception characteristics thereof. The dimensions are illustrated in FIG. 3 and the corresponding dimensions in millimeters (mm) of the illustrated example are shown in Table 1 below. Those dimensions not illustrated in FIG. 3 are readily discernible from the dimensions provided. The dimensions of the folded dipole 302, the matching network 304, and the transmission lines 306 and 308 are generally based on the desired transmission wavelengths during operation. While the example dimensions given in Table 1 provide measurements of the example PCB 300, the example folded dipole antenna 302, the example matching network 304, and the example transmission lines 306 and 308 for a 2.4-2.5 GHz operating band, these dimensions may also be considered in terms of ratios. By maintaining the ratios of Table 1, the example PCB 300, the example folded dipole antenna 302, the example matching network 304, and the example transmission lines 306 and 308 may be scaled to use another desired operating frequency or operating band.

TABLE 1

| Dimension | Value (mm) |
|---|---|
| A | 2.00 |
| B | 0.50 |
| C | 1.00 |
| D | 2.00 |
| E | 24.1 |
| F | 24.1 |
| G | 1.17 |
| H | 3.88 |
| I | 1.34 |
| J | 5.66 |
| K | 11.2 |
| L | 23.00 |
| M | 20.5 |
| N | 16.75 |
| O | 4.06 |
| P | 18.53 |
| Q | 7.65 |
| R | 60.00 |
| S | 2.68 |
| T | 1.00 |

The example PCB 300 includes at least two portions 310 and 312. The first portion 310 is adjacent a portion of an intermediate layer of the PCB 300 (e.g., the intermediate layer 104 of FIG. 1) that is constructed of a dielectric material and does not include a ground plane. The second portion 312 is adjacent a portion of an intermediate layer of the PCB 300 that includes a conductive ground plane. In some examples, the PCB 300 includes a separation between the portions 310 and 312. The separation 314 may be an area including an appropriate separation material, an area having no material at all, or a discontinuity between the non-conductive material in the portion 310 and the conductive ground plane material in the portion 312.

The folded dipole 302 includes two portions 316 and 318. The first portion 316 of the folded dipole 302 is located on the first side 301, visible as shown in FIG. 3, of the PCB 300. The second portion 318 of the folded dipole 302 is located on the second side 401 of the PCB 300 as illustrated in FIG. 4. The first portion 316 and second portion 318 of the folded dipole 302 are electrically coupled via several conductive vias 320*a* that provide electrical connections between components on different layers of PCB.

The example folded dipole portion 316 is also divisible into three microstrip sections 317*a*, 317*b*, and 317*c*. The example microstrip sections 317*a* and 317*c* are substantially parallel, and the microstrip section 317*b* is substantially orthogonal to the microstrip sections 317*a* and 317*c*. The example microstrip section 317*a* measures A by E when measuring from the electrical vias 320*a*, the example microstrip section 317*b* measures B by D, and the example microstrip section 317*c* measures C by E. In some examples, the microstrip sections 317*a*, 317*b*, and/or 317*c* are connected via mitered bends to achieve a desired impedance. The other example folded dipole portion 318 may be divided into similar microstrip sections 319*a*, 319*b*, and 319*c* having substantially equal respective dimensions. The example microstrip sections 319*a*, 319*b*, and 319*c* are illustrated below in FIG. 4.

When considering balanced conductors in pairs of transmission lines, antennas, or matching networks, the conductors maintain the same impedance at the terminals with respect to ground. Balanced transmission lines are often used with differential signals, such as twisted wire pairs, and minimize differential voltages or currents due to stray electrical fields. The portions 316 and 318 of the folded dipole 302 are located on different sides of the PCB 300 to maintain a balanced antenna system. Similarly, the transmission lines 306 and 308 are equal or substantially equal in length and width to maintain a balanced transmission line and equal impedances at the matching network terminals.

While the example folded dipole 302 is 1 mm from the edge of the PCB 300 (i.e., dimension T), the PCB 300 may be implemented using a large PCB. In such an example, the area between the folded dipole 302 and the edges of the PCB 300 as illustrated in FIG. 3 are free of other components and/or conductive elements.

At an end opposite the folded dipole, the transmission lines 306 and 308 terminate at the balanced matching network 304. In the illustrated example, the matching network 304 includes two portions 322 and 324 corresponding to the two portions 316 and 318 of the folded dipole 302, respectively. The matching network 304 matches an impedance of the folded dipole 302 and transmission lines 306 and 308 to the impedance of an output port of the transceiver 303. For example, the matching network 304 will provide an appropriate impedance to cancel reactance in the transceiver 303 output impedance. The output port includes two output pins 326 and 328 coupled to respective portions of the matching network 304.

To match the impedance at the output of the transmission line 306 to the impedance at the input of the transceiver 303, the example matching network portion 324 includes a first tapered microstrip 325*a*, and second and third substantially perpendicular microstrips 325*b* and 325*c*, respectively. The first microstrip 325*a* is tapered such that the narrow end is coupled to the transmission line 306, and the wide end is coupled to the second microstrip 325*b*. As a result, the first microstrip 325*a* provides inductance (i.e., positive reactance) to the matching network. The second and third microstrips 325*b* and 325*c* share a mitered bend, which reduces reflected radio frequency waves that are normally caused by abrupt orthogonal changes in the trace direction. The thicknesses and lengths (shown in Table 1) of the microstrips 325*a*-325*c* result in an impedance, which, when added to the output impedance at the transmission line 326, matches or substantially matches the input impedance of the transceiver 303. The example matching network portion 322 includes similar microstrips that cause substantially the same effect as the microstrips 325*a*-325*c*, respectively.

The matching network 304, like the folded dipole 302 and transmission lines 306 and 308, is balanced. To this end, the matching network 304 is substantially symmetrical. The portion 324 of the matching network 304 is partially located on the second side 401 of the PCB 300 to be electrically connected to the transmission line 308. The portion 324 includes one or more conductive vias 320*b* to electrically couple the two layers of the PCB 300.

The example transceiver 303 further includes a power port 330 to provide DC power to the antenna and the output pins 326 and 328 while the transceiver 303 is transmitting. The power port 330 provides the DC power via a power trace 332, which is located on the second side 401 of the PCB 300 and electrically coupled to the power port 330 via one or more vias 320*c*. The power trace 332 is then coupled to an inductive stub trace 334 located on the first side 301 of the PCB 300 via one or more vias 320*d*. The inductive stub trace 334 provides the DC power from the power port 330 to the matching network 304, and therefore to the folded dipole 302. While the inductive stub trace 334 electrically couples the portions 322 and 324 of the matching network 304, the inductive stub trace 334 may be structured to include an inductance between the portions 322 and 324. Thus, the portions 322 and 324 are DC coupled but are not communicatively coupled via the inductive stub trace 334.

FIG. 4 is a view of the second side 401 of the example multi-layered PCB 300 of FIG. 3. The example PCB 300 includes all of the regions (e.g., 310, 312, and 314) and components illustrated in FIG. 3, although some of the components (e.g., the transmission line 306) are not visible. In the view of the second side 401, the transmission line 308 is visible, and couples the second portion 318 of the folded dipole 302 to the corresponding portion 324 of the matching network 304. As shown in FIG. 4, the power trace 332 is coupled to the inductive stub trace 334 via the one or more vias 320*d*.

Additionally, the example second portion 318 of the folded dipole 302 includes dimensions A, B, C, and D substantially equal to the respective dimensions A-D of the first portion 316. The example second portion 318 includes three microstrip sections 319*a*, 319*b*, and 319*c*, which are substantially equal in dimensions and shape as respective microstrip sections 317*a*, 317*b*, and 317*c* illustrated in FIG. 3.

In some example applications, the folded dipole antenna 302, transmission lines 306 and 308, and matching network 304 are useful for two-way communications in the Wi-Fi (i.e., 2.4 GHz) and Zigbee (i.e., 868 MHz, 915 MHz, or 2.4 GHz) frequency ranges or frequency bands. Using such frequencies and designing the example antenna system for substantial efficiency, the antenna system may be implemented using a PCB suitable for fitting into a portable device. The example folded dipole antenna 302, the transmission lines 306 and 308, and the matching network 304 are balanced and implemented using conductive traces, or microstrips, affixed to the layers of the PCB.

The structure of the example folded dipole 302, the example transmission lines 306 and 308, and the example matching network 304 may be designed such that impedance matching between the folded dipole antenna and the transceiver 303 is achieved without using discrete matching components. In designing the matching network 304 to provide impedance matching from the terminals of the transmission lines 306 and 308 to the transceiver terminals 326 and 328, a Smith chart or similar tool may show that positive or negative reactance is necessary to achieve purely resistive (i.e., real) impedance.

The portions 322 and 324 are coupled to the ground plane in the region 312 via shunt capacitive elements 336. The shunt capacitive elements 336 are coupled to the inductive stub trace 334 and the matching network portions 322 and 324 via the one or more vias 320*d*. In the example of FIGS. 3 and 4, the shunt capacitive elements 336 are selected to have capacitance values that series resonate with any stray inductance, and therefore reduce high frequency noise and provide improved balance in the matching network. To couple the shunt capacitive elements to the ground plane, electrical contacts (e.g., conductive microstrips) 338*a* and 338*b* are located in the region 312 and are electrically coupled to the ground plane. The capacitance value of the example shunt capacitive element 336 is selected to avoid interfering with the operating frequencies of the folded dipole antenna 302.

In the example case, a positive reactance is necessary to achieve a purely resistive impedance. Typically, a bulk inductance component such as a discrete inductor or capacitor may be used. In this example of FIGS. 3 and 4, however, the vias 320*a* coupling the portions of the folded dipole 316 and 318 provide a small amount of inductance, which slightly reduces the physical length of the dipole antenna 302. Additionally or alternatively, the inductance caused by the vias 320*a* may shorten the length of the folded dipole 302 and transmission lines 306 and 308, thus making the folded dipole 302 and corresponding PCB 300 smaller, but also changing the reactance implemented into the matching network to provide appropriate matching.

The structure of the illustrated matching network 304, including the symmetry between the portions 322 and 324 and the angles of the matching network 304 structure, contribute to add reactance. Another feature that adds reactance is the tapering of the first microstrip 325*a* as the trace approaches the transmission lines 306 and 308. The features utilized in the example matching network 304 contribute to add an appropriate resistance to match the resistance at the transmission lines 306 and 308 and add or subtract an appropriate reactance to eliminate the reactance at the transmission lines 306 and 308.

Figure 5:
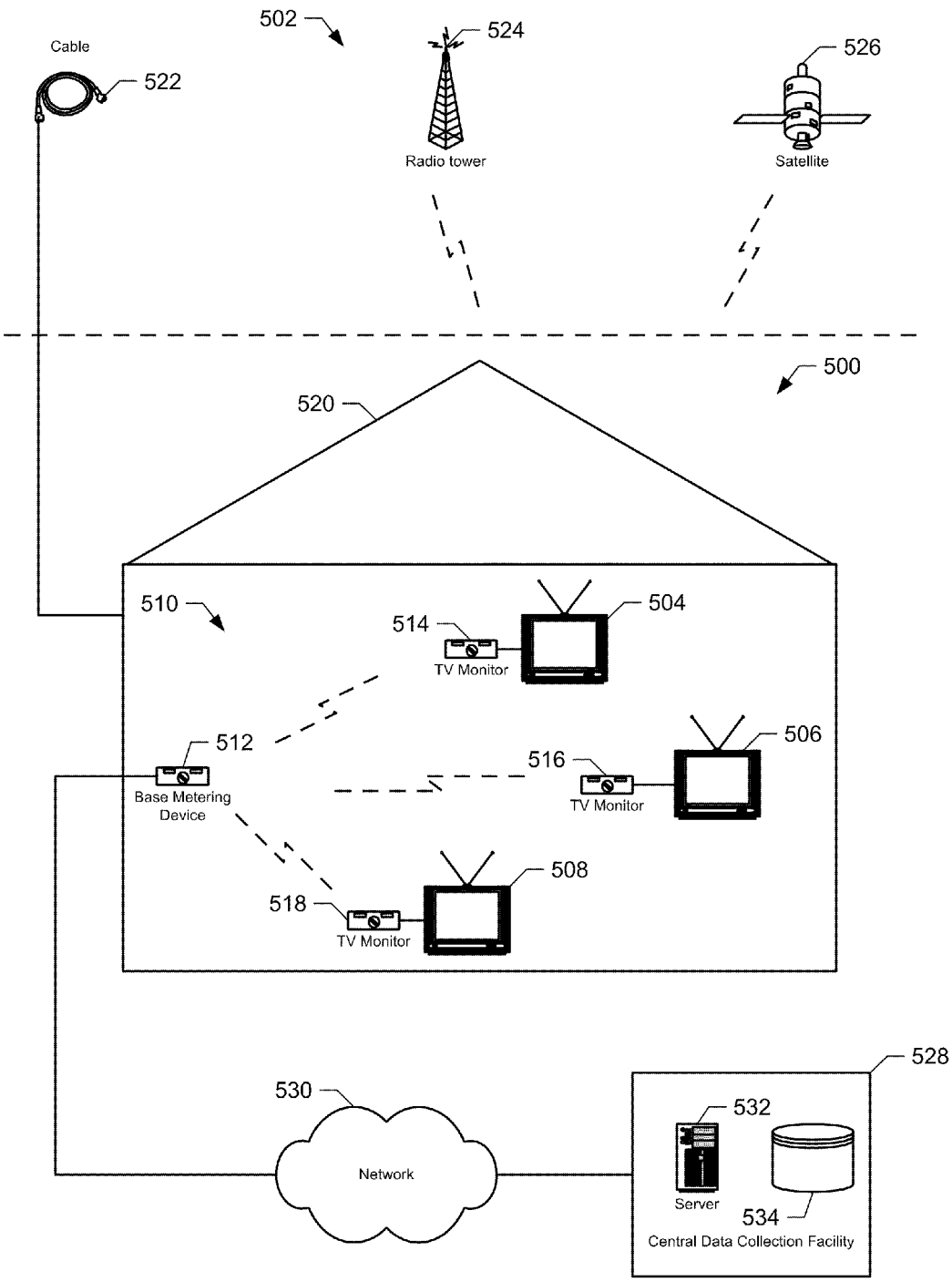
FIG. 5 is an example audience measurement application of the example balanced microstrip antennas described herein.

FIG. 5 is an example audience measurement application of the example balanced microstrip antennas described herein. An example television system 500 including a television service provider 502, and several televisions 504, 506, and 508, is metered using an audience measurement system 510 having a base metering device 512 and several television metering devices 514, 516, and 518. Any one or more of the example base metering device 512 and/or the example television metering devices incorporate the example folded dipole 302, the example matching network 304, the example transmission lines 306 and 308, and/or, more generally, the example antenna 100 described in FIGS. 1-4 above for wireless communication of television viewing data and/or control information. The televisions 504, 506, and 508 are positioned in multiple viewing area located within a household 520 occupied by one or more people, all of whom have agreed to participate in an audience measurement research study. Any or all of the televisions 504, 506, or 508 may be viewed by one or more audience members.

The television service provider 502 may be implemented using any television service provider 502 such as, but not limited to, a cable television service provider 522, a radio frequency (RF) television provider 524, and/or a satellite television service provider 526. One or more of the televisions 504, 506, and/or 508 receive a plurality of television signals transmitted via a plurality of channels by the television service provider 502 and may be adapted to process and display television signals provided in any format such as an National Television Standards Committee (NTSC) television signal format, a high definition television (HDTV) signal format, an Advanced Television Systems Committee (ATSC) television signal format, a phase alternation line (PAL) television signal format, a digital video broadcasting (DVB) television signal format, an Association of Radio Industries and Businesses (ARIB) television signal format, etc. Referring to the example television 504 and television metering device 514, the television 504 may tune to and receive signals transmitted on a desired channel, and to cause the television 504 to process and present the programming content contained in the signals transmitted on the desired channel. The processing performed by the television 504 may include, for example, extracting a video component delivered via the received signal and an audio component delivered via the received signal, causing the video component to be displayed on a screen/display associated with the television 504, and causing the audio component to be emitted by speakers associated with the television 504. The programming content contained in the television signal may include, for example, a television program, a movie, an advertisement, a video game, and/or a preview of other programming that is or will be offered by the television service provider 502 now or in the future.

The base metering device 512 is configured as a primarily stationary device disposed on or near the television 504 and may be adapted to perform one or more of a variety of well known television metering methods. Depending on the types of metering that the television metering device 514 is adapted to perform, the television metering device 514 may be physically coupled to the television 504 or may instead be configured to capture signals emitted externally by the television 504 such that direct physical coupling to the television 504 is not required. Preferably, a television metering device 514 is provided for each television 504 disposed in the household 520, such that the television metering devices 514, 516, or 518 may be adapted to capture data regarding all in-home viewing by the household members. In one embodiment, the television metering device 514 may be implemented as a low-cost electronic device that may be shipped to the viewer's household 520 (e.g., via regular mail) and easily installed by the viewer by, for example, plugging the television metering device 514 into a commercial power supply, i.e., an electrical outlet. The television metering devices 514, 516, and 518 include the example balanced folded dipole antenna described above and are portable or semi-portable so as to be conducive to mailing.

The base metering device 512 may be adapted to communicate with a remotely located central data collection facility 528 via a network 530. The network 530 may be implemented using any type of public or private network such as, but not limited to, the Internet, a telephone network, a local area network (LAN), a cable network, and/or a wireless network. To enable communication via the network 530, the base metering device 512 may include a communication interface that enables connection to an Ethernet, a digital subscriber line (DSL), a telephone line, a coaxial cable, or any wireless connection, etc. The base metering device 512 may be adapted to send viewing data to the central data collection facility 528. The central data collection facility 528 may include a server 532 and a database 534. Further, the central data collection facility 528 may be adapted to process and store data received from the base metering device 512.

The example audience measurement system 510 is configured so that the base metering device 512 is the primary source to collect all in-home viewing data from the television metering devices 514-518, using the example antenna described above and/or a similarly scaled antenna, using WiFi (e.g., 2.4 gigahertz (GHz)) and/or Zigbee (e.g., 868 megahertz (MHz), 915 MHz, or 2.4 GHz) protocols and/or frequencies. The base metering device 512 and one or more of the television metering devices 514-518 may be provided with a wireless communications adapter, a transceiver, and the example microstrip folded dipole antenna described above to provide the base metering device 512 with television viewing data from the television metering devices 514-518. Due to the increased range and performance of the example microstrip folded dipole antenna, the base metering device 512 and the television metering devices 514-518 have increased freedom of physical location within the household 520 while maintaining wireless communications.

Accordingly, while the above specification describes example methods and apparatus, the examples are not the only way to implement such methods and apparatus. Therefore, although certain example methods and apparatus have been described herein, the scope of coverage of this patent is not limited thereto. On the contrary, this patent covers all methods and apparatus fairly falling within the scope of the appended claims either literally or under the doctrine of equivalents.

What is claimed is:

1. An antenna system, comprising:

a printed circuit board comprising a first dielectric layer and a second dielectric layer;

a conductive ground plane bounded by respective portions of the first and second dielectric layers of the printed circuit board;

a balanced folded dipole, wherein a first portion of the folded dipole is located on the first dielectric layer, and a second portion of the folded dipole is located on the second dielectric layer;

first and second transmission lines coupled to respective folded dipole portions; and a balanced matching network comprising first and second portions, the first and second matching network portions coupled to respective transmission lines and having substantially equal electrical impedances, each portion comprising:

a tapered first microstrip, comprising a narrow end electrically coupled to a respective transmission line;

a second microstrip electrically coupled to the first microstrip; and a third microstrip coupled substantially orthogonally to the second microstrip via a mitered bend.

2. An antenna system as defined in claim 1, wherein the folded dipole is not located adjacent the ground plane.

3. An antenna system as defined in claim 1, wherein the first and second portions of the folded dipole are coupled via electrical vias through the first and second dielectric layers.

4. An antenna system as defined in claim 1, wherein the antenna operates in at least one of the 2.4 GHz WiFi or the 868 MHz, 915 MHz, or 2.4 GHz Zigbee frequency ranges.

5. An antenna system as defined in claim 1, wherein at least one of the matching network portions further comprise one or more electrical vias to couple the respective first microstrip to the respective transmission line on the second dielectric layer.

6. An antenna system as defined in claim 1, wherein the first and second portions of the matching network are direct-current (DC) coupled via a DC microstrip trace.

7. An antenna system as defined in claim 1, wherein the folded dipole and at least a portion of the transmission lines are not adjacent the ground plane, and at least a portion of the matching network is adjacent the ground plane.

8. An antenna system as defined in claim 1, wherein the first transmission line is located on the first dielectric layer and the second transmission line is located on the second dielectric layer.

9. An antenna system as defined in claim 1, wherein the first matching network microstrip is tapered in width, having a width ratio of substantially 1.17 to substantially 1.34.

10. An antenna system as defined in claim 9, wherein the second matching network microstrip has a width to height ratio of substantially 1.34 to substantially 7.65.

11. An antenna system as defined in claim 10, wherein the third matching network microstrip has a width to height ratio of substantially 1.0 to substantially 2.0.

12. An antenna system as defined in claim 1, wherein the first portion of the folded dipole comprises:

a first microstrip section coupled to the second folded dipole portion, the first microstrip having a length to width ratio of substantially 24.1 to substantially 2.0;

a second microstrip section coupled substantially orthogonally to the first microstrip and having a length to width ratio of substantially 2.0 to substantially 0.5 millimeters; and a third microstrip section coupled to the second microstrip and the first portion of the transmission line and substantially parallel to the first microstrip, the third microstrip having a length to width ratio of substantially 24.1 to substantially 1.0.

13. An apparatus to transmit or receive wireless signals, comprising:

a printed circuit board including:

a first dielectric layer;

a second dielectric layer; and an intermediate layer located between the first layer and the second layer, wherein a first portion of the intermediate layer comprises a ground plane and a second portion of the intermediate layer comprises a dielectric material;

a balanced folded dipole antenna, comprising a first conductive trace portion located on the first dielectric layer coupled to a second conductive trace portion located on the second dielectric layer, wherein the first and second conductive trace portions are electrically coupled via the intermediate layer and are adjacent the second portion of the intermediate layer, the first conductive trace portion comprising:

a first microstrip section coupled to the second folded dipole portion, the first microstrip having a length to width ratio of substantially 24.1 to substantially 2.0;

a second microstrip section coupled substantially orthogonally to the first microstrip and having a length to width ratio of substantially 2.0 to substantially 0.5 millimeters; and a third microstrip section coupled to the second microstrip and the first portion of the transmission line and substantially parallel to the first microstrip, the third microstrip having a length to width ratio of substantially 24.1 to substantially 1.0;

a balanced matching network to provide impedance matching between the folded dipole antenna and an integrated circuit, comprising third and fourth conductive traces, at least one of the third or fourth conductive traces comprising:

a tapered first microstrip, comprising a narrow end electrically coupled to a respective transmission line and having a width ratio of substantially 1.17 to substantially 1.34;

a second microstrip electrically coupled to the first microstrip and having a width to height ratio of substantially 1.34 to substantially 7.65; and a third microstrip coupled substantially orthogonally to the second microstrip via a mitered bend and having a width to height ratio of substantially 1.0 to substantially 2.0; and a balanced transmission line, comprising:

a fifth conductive trace located on the first dielectric layer to couple the first and third conductive traces; and a sixth conductive trace located on the second dielectric layer to couple the second and fourth conductive traces.

14. An apparatus as defined in claim 13, further comprising a seventh conductive trace to selectively provide power to the matching network for transmitting signals via the folded dipole antenna.

15. An apparatus as defined in claim 14, wherein a integrated circuit provides power to the folded dipole antenna via the seventh conductive trace.

16. An apparatus as defined in claim 13, wherein the matching network is located on the first dielectric layer within the portion of the intermediate layer comprising the ground plane.

17. An apparatus as defined in claim 13, wherein the third conductive trace is symmetrical to the fourth conductive trace with respect to a line coextensive with the balanced transmission line.

18. An apparatus as defined in claim 13, wherein the antenna operates in at least one of the 2.4 GHz WiFi or the 868 MHz, 915 MHz, or 2.4 GHz Zigbee frequency ranges.

19. An antenna system as defined in claim 13, wherein the fourth conductive trace further comprises one or more electrical vias to couple the respective first microstrip to the sixth conductive trace.

20. An antenna system as defined in claim 13, wherein the folded dipole and at least a portion of the transmission lines are not adjacent the ground plane, and at least a portion of the matching network is adjacent the ground plane.

* * * * *